United States Patent [19]

Nielsen

[11] Patent Number: 4,632,643

[45] Date of Patent: Dec. 30, 1986

[54] SUMP PUMP

[76] Inventor: Axel L. Nielsen, 1316 E. Elza, Hazel Park, Mich. 48030

[21] Appl. No.: 701,776

[22] Filed: Feb. 14, 1985

[51] Int. Cl.[4] ..... F04B 39/06

[52] U.S. Cl. ..... 417/367; 310/55; 310/87

[58] Field of Search ..... 417/367, 424, 368, 366; 310/55, 62, 87

[56] References Cited

U.S. PATENT DOCUMENTS

| | | | |
|---|---|---|---|
| 2,321,126 | 6/1943 | Breuer | 417/367 |
| 2,363,419 | 11/1944 | Howard | 417/367 |
| 2,410,973 | 11/1946 | Hoover | 417/367 X |
| 2,568,348 | 9/1951 | Howard et al. | 417/367 X |
| 2,661,146 | 12/1953 | Hill et al. | 417/368 |
| 2,776,385 | 1/1957 | Modrey | 417/368 |
| 2,787,720 | 4/1957 | Ethier et al. | 417/367 |
| 3,135,213 | 6/1964 | Smith et al. | 417/368 |
| 3,136,258 | 6/1964 | Bood | 417/367 |
| 3,653,785 | 4/1972 | Dahlgren et al. | 417/367 |
| 3,822,967 | 7/1974 | Cade et al. | 417/368 |
| 3,957,402 | 5/1976 | Sloan | 417/367 |
| 4,052,765 | 10/1977 | Guhne et al. | 417/367 X |
| 4,201,524 | 5/1980 | Wilkins | 417/364 |

*Primary Examiner*—Carlton R. Croyle
*Assistant Examiner*—Theodore Olds
*Attorney, Agent, or Firm*—Barnes, Kisselle, Raisch, Choate, Whittemore & Hulbert

[57] ABSTRACT

An electrical motor operated sump pump has a motor mounted above a centrifugal sump pump. The motor is fully enclosed in a chamber in which the top plate of the pump is the bottom wall. The motor is provided with a casing having air inlet openings in a bottom wall and outlet openings at its top with an upwardly directed internal fan providing a downward flow of air surrounding the casing and inwardly across the top surface of the pump housing, to provide efficient cooling. When the sump water reaches the set limit to operate the pump, the lateral wall of the chamber in which the motor is mounted, this furnishes additional cooling of the circulated air.

2 Claims, 5 Drawing Figures

SUMP PUMP

BACKGROUND AND SUMMARY

The present invention relates to a sump pump comprising a centrifugal pump located at the bottom of a sump in which water is collected to be discharged when the water reaches a predetermined level.

The pump has the axis of its rotor vertical and includes a housing having a water inlet at its bottom. The motor is connected directly to the pump rotor and includes a casing the bottom wall of which is spaced above the top wall of the pump housing and is provided with air inlet ports. The motor casing has top air outlet ports extending around its circumference adjacent the top. The motor is provided with a conventional fan within the casing. The motor casing is located centrally in a chamber having a closed cylindrical side wall spaced uniformly a slight distance from the motor casing, and defines a 360° restricted air passage which extends for the full axial length of the motor casing. The top wall of the chamber is sealed to the lateral wall and serves as a mount for a switch which controls the motor. The bottom wall of the chamber is formed by the top wall of the pump housing.

Accordingly, the motor is cooled by air entrapped within the chamber, and the air is cooled by contact with the lateral wall of the chamber, which in turn is cooled by water in the sump to the level of the water. In addition, the entrapped air is cooled by flowing over the top wall of the pump housing, which of course is cooled by the sump water passing through the pump is in operation.

An important factor in the cooling of the circulating air is that an elongated annular passage of restricted uniform width is provided so that circulating air is positively cooled during its flow out of the upper motor casing outlet ports, down through the elongated, restricted annular passage and thence radially inwardly across the 360° space surrounding the mounting connection between the pump and motor.

It will be observed that the motor is fully sealed against entrance of water into the totally enclosed submersible chamber in which the motor casing is received.

This construction permits use of a motor normally intended for cooling by ambient air to be located in a sealed chamber which is submersible while entrapped air flow is directed for efficient cooling. This opens a broader field for a regular sump pump motor intended to be cooled by flow of room air, and eliminates the need for cooling oil inside the housing. In addition the unique design makes it simple to increase the height of the chamber, thus increasing the volume of air entrapped in therein, and also increasing the off and on limits of the liquid level. It has all of the advantages and none of the disadvantages of an upright sump pump. It makes it possible to use any standard sump pump motor in the 48 frame, which is standard as manufactured by General Electric, Westinghouse, Emerson, Century and many other motor manufacturers.

The combination disclosed herein completely overcomes the disadvantage of prior "upright" sump pumps, in which, if they fail to operate, due to mechanical trouble or power failure, permit the water to rise over the switch and motor and make the pump inoperable.

My construction may be described as an upright-submersible float operated motor driven sump pump. This is accomplished by mounting the motor on a hollow boss on the exact center, so that the motor is mounted on this boss, with its shaft extending through it for connection to the pump impeller, the boss constituting the sole mounting of the motor on the pump.

COMPLETE DESCRIPTION

Figure 1:
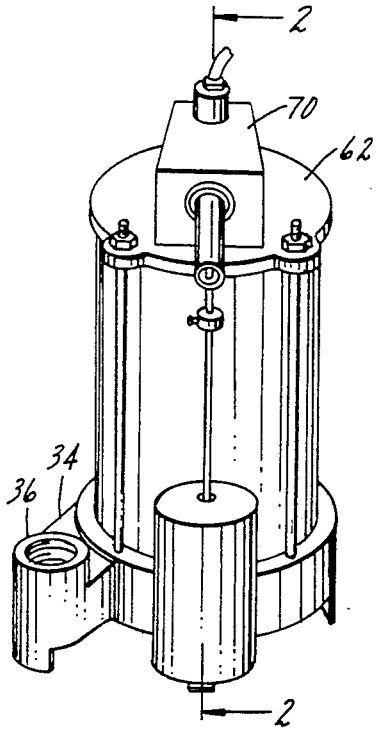
FIG. 1 is a perspective view of the pump and motor combination.

Referring now to the drawings, the upright or pedestal type sump pump 10 comprises a housing made up of a casting 12 which is in the form of a generally flat top enclosure plate 14 having centrally thereof an upwardly extending tubular boss 16, a cylindrical side wall 18 having at its lower edge an inwardly extending flange 20 defining a downwardly open inlet opening. Below the opening a plate 22 is carried by supports 24 which protects the opening from entry of foreign articles. Casting 12 has legs 26 which supports the entire assembly on the floor 28 of the sump. The plate 14, side wall 18, and bottom flange 20 define a pump rotor cavity 29 in which an impeller 30 is rotatable.

Figure 5:
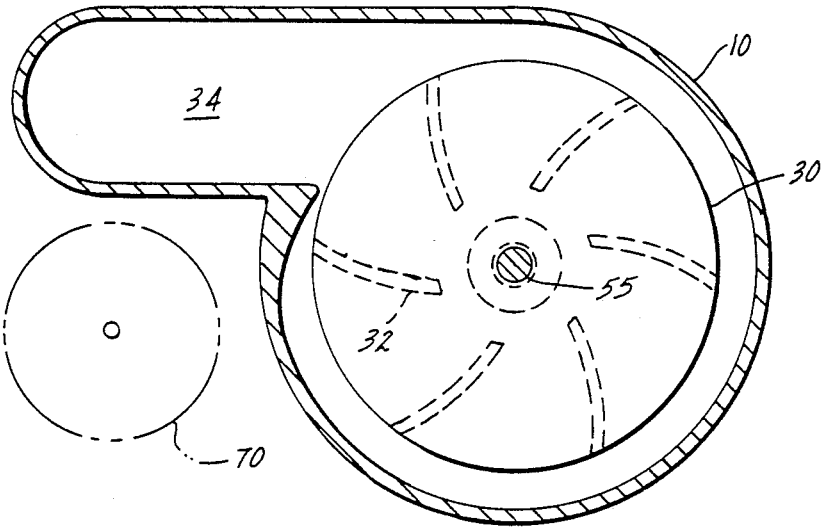
FIG. 5 is a section on line 5—5, FIG. 2.

As best seen in FIG. 5, the impeller has inclined vanes 32 which upon rotation of the impeller counter-clockwise as seen in FIG. 5, direct sump water into a laterally extending outlet passage 34 having at its top a connection 36 for a vertical outlet pipe, not shown.

Figure 2:
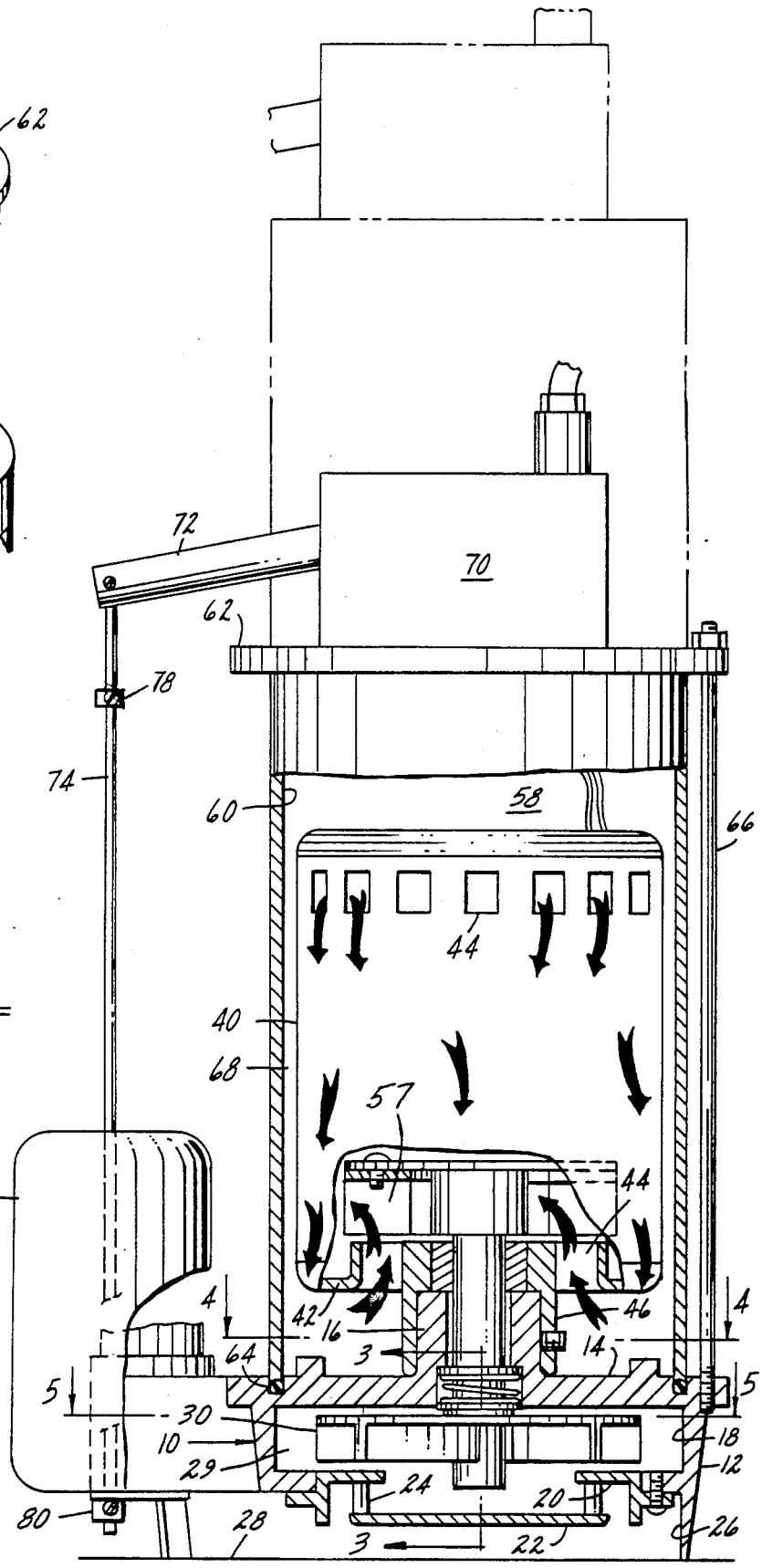
FIG. 2 is an enlarged elevation, partly in section on line 2—2, in FIG. 1.
Figure 3:
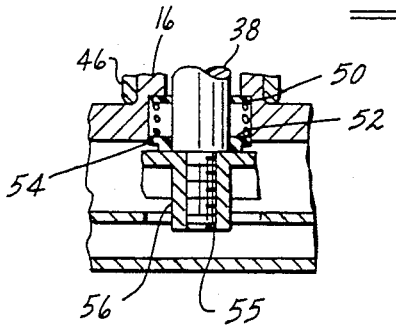
FIG. 3 is a fragmentary section on the line 3—3, FIG. 2.
Figure 4:
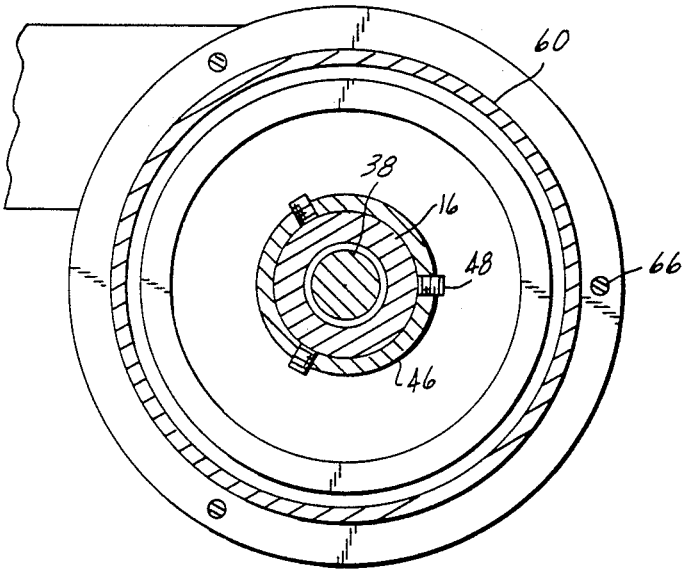
FIG. 4 is a section on line 4—4, FIG. 2.

The impeller 30 is connected to motor shaft 38, best seen in FIGS. 3 and 4, which extends downward through tubular boss 16. The motor is a standard sump pump motor identified in the trade as "a 48 frame", and is available from many motor manufacturers, such as General Electric and Westinghouse for example. The motor is intended for operation in room air, and for such operation is provided with a cylindrical casing 40 having bottom wall 42 with apertures 44 providing for inlet flow of cooling air, as indicated by the arrows in FIG. 2. The motor casing 40 is closed at its top and adjacent the top are a series of outlet openings 44.

The motor casing 40 has a downwardly extending tubular extension 46 which engages on the tubular boss 16 of the pump 10, and constitutes the sole and entire support for the motor. Set screws 48 are provided to secure the mounting.

The boss 23, as best seen in FIG. 3, has seals 50 and 52 separated by a compression spring 54. The bottom end 55 of shaft 38 is reduced and provided with a left-hand thread which connects with a threaded element 56 of the impeller 30. The motor includes a fan for circulating cooling air upwardly therethrough.

The motor including its casing 40 is completely enclosed in a sealed air chamber 58 defined by a cylindrical shell 60, a top closure plate 62, and the portion of enclosure plate 14 of the pump housing located within the shell 60. Plate 14 has a circular recess which receives a seal 64 and a similar sealing construction is provided at the top edge of shell 60 for plate 62. Plates 14 and 62 are clamped in the illustrated relationship by the rods 66.

The motor casing 40 is centrally located in the chamber 58 and a vertically elongated narrow annular passage 68 of limited uniform width is provided between shell 60 and motor casing 40. The dimensions are such that this passage permits unrestricted flow of cooling air while providing maximum transfer of heat from the air to the shell 60. It will be understood that when motor operation is initiated, sump water surrounds at least the lower portion of shell 60, which enhances the cooling effect on air heated by passage through the interior of motor casing 40 as it flows downwardly in intimate contact with the inner surface of shell 60.

In addition the pump chamber is filled with sump water and its top plate 14 is thus cooled to increase cooling of the air as it emerges from annular passage 68 and flows radially inwardly to inlet ports 44. Furthermore, shell 60 extends substantially above the motor as seen in full lines in FIG. 2, and the height of the shell may be increased as indicated in dotted lines in this Figure. This increases the volume of air within the air chamber 58 which increases the overall cooling effect. The air, as it enters motor casing 40, has undergone maximum cooling just prior to entrance.

It has been found that the described arrangement provides fully adequate cooling of the sump pump motor in extended operation.

As is usual, motor operation is controlled by switch means within switch housing 70 mounted on the top plate 62 of the air chamber 38. The switch is of the usual type and has an operating arm 72 connected to a rod 74 on which a float 76 is slidable. Adjustable stops 78 and 80 on the rod control initiation of pump operation when the float engages stop 78 and termination of operation when the sump is substantially emptied. It is of course obvious that when the height of shell 60 is increased as indicated in dotted lines in FIG. 2, the range of adjustment of water level may be corresponding increased.

The diameter of the cylindrical shell forming the outer wall of said air chamber being spaced as closely as possible to the cylindrical wall of said motor casing while avoiding a appreciable restriction to air flow through the annular flow passage therebetween.

From the foregoing, it will be apparent that there is provided the combination of a motor, pump, and sealed air chamber characterized in a novel and highly efficient cooling system for the motor.

To accomplish this the motor is supported solely by the central boss 16 provided on the top wall of the pump housing.

The sealed air chamber 60 has a cylindrical side wall spaced uniformly from the cylindrical wall of the motor casing to define a completely unobstructed annular passage of 360° circumferential extent.

The radial dimension of the air passage is a minimum to avoid appreciable restriction to air flow, which of course provides maximum heat transfer to the cylindrical wall of the air chamber.

The air flow at the bottom of the air chamber into the motor casing is also unobstructed through 360° and in addition is across the top wall 14 of the pump housing, which is cooled by the passage of sump water through the pump.

I claim:

1. A submersible sump pump assembly adapted to be supported on the floor of a sump and to be submerged in water as it rises in the sump, comprising an impeller housing having a flat generally horizontal top wall provided centrally thereof with an upward tubular extension, an impeller in said housing for pumping water in said sump to a discharge pipe, a motor having a drive shaft extending downwardly through said tubular extension and connected to said impeller, said motor having a casing provided with a vertically elongated cylindrical side wall, a top wall and a bottom wall provided with a central tubular downward extension of smaller diameter than said side wall telescoped with said extension of the top wall of the impeller housing and constituting the sole support for said motor, said bottom wall of said casing being spaced above said top wall of said impeller housing, said motor casing having an annular series of air inlet ports in its bottom wall surrounding said extensions and an annular series of air outlet ports at its upper end, means within said motor casing for circulating cooling air upwardly therethrough, a vertically elongated cylindrical, sealed air chamber in which said motor is received, said air chamber comprising a vertically extending cylindrical shell adapted to be submerged in and contacted by water in said sump, said cylindrical shell being spaced uniformly from the side wall of said motor casing at a short distance to define an unobstructed 360° vertically elongated lateral air passage of total cross-section only sufficient to provide air flow therethrough without substantial restriction while providing maximum heat transfer from said motor casing through the air to the wall of said chamber, said air chamber having a top wall spaced above and completely separated from said top wall of said motor casing to provide for a volume of air in unobstructed 360° communication with said lateral air passage, the top wall of said impeller housing forming the bottom wall of said air chamber and being spaced beneath the bottom wall of said motor casing to provide an annular bottom air passage between the portions of the bottom wall of said motor casing and top wall of said impeller housing surrounding said telescoping extensions in unobstructed 360° communication with said lateral air passage, cooling air flow exteriorly of the motor casing being downwardly through said lateral air passage and then inwardly through said bottom air passage.

2. A sump pump as defined in claim 1, wherein said top wall of said air chamber is a removable plate, and said cylindrical shell of said air chamber is clamped between tie rods extending from said removable plate to the top wall of said impeller housing to provide for substitution of cylindrical shells of different lengths.

* * * * *